US008756865B2

(12) United States Patent
Nicholson et al.

(10) Patent No.: US 8,756,865 B2
(45) Date of Patent: Jun. 24, 2014

(54) DOOR SYSTEMS AND METHODS

(71) Applicant: Anthony International, Sylmar, CA (US)

(72) Inventors: Jeffrey William Nicholson, Palmdale, CA (US); Aaron Anthony Sanchez, Los Angeles, CA (US); Paul J. Artwohl, Stevensville, MI (US)

(73) Assignee: Anthony International, Sylmar, CA (US)

( * ) Notice: Subject to any disclaimer, the term of this patent is extended or adjusted under 35 U.S.C. 154(b) by 0 days.

(21) Appl. No.: 13/646,536

(22) Filed: Oct. 5, 2012

(65) Prior Publication Data

US 2014/0083013 A1 Mar. 27, 2014

Related U.S. Application Data

(60) Provisional application No. 61/704,427, filed on Sep. 21, 2012.

(51) Int. Cl.
*E05D 15/22* (2006.01)

(52) U.S. Cl.
USPC ..... 49/180; 49/142; 49/177

(58) Field of Classification Search
USPC ..... 49/163, 164, 168, 172, 176–178, 180, 49/181, 190, 191, 142, 143, 260
See application file for complete search history.

(56) References Cited

U.S. PATENT DOCUMENTS

| | | | | | |
|---|---|---|---|---|---|
| 1,473,982 | A * | 11/1923 | Watson | 49/421 |
| 2,076,835 | A * | 4/1937 | Young | 312/295 |
| 3,464,159 | A * | 9/1969 | Hewitt et al. | 49/177 |
| 5,394,648 | A * | 3/1995 | Kordes | 49/177 |
| 5,749,172 | A * | 5/1998 | Isopahkala | 49/127 |
| 5,832,980 | A * | 11/1998 | Cianciolo | 160/197 |
| 6,058,665 | A * | 5/2000 | Halvorson et al. | 52/205 |
| 6,618,994 | B1 * | 9/2003 | Nussbaum | 49/180 |
| 7,950,439 | B2 * | 5/2011 | Anderson | 160/211 |
| 8,381,443 | B2 * | 2/2013 | Smith et al. | 49/141 |
| 2011/0094161 | A1 * | 4/2011 | Rees | 49/260 |
| 2012/0073205 | A1 * | 3/2012 | Hamaker et al. | 49/163 |

* cited by examiner

*Primary Examiner* — Katherine Mitchell
*Assistant Examiner* — Scott Denion
(74) *Attorney, Agent, or Firm* — Knobbe, Martens, Olson & Bear, LLP

(57) ABSTRACT

A door system can have a door that can both slide and pivot open. The door can be positioned in a door frame. The door can slide within the door frame using tracks, rollers, and/or guides. The door can be prevented from swinging open while the door is sliding along the doorframe. The door can swing open along a pivot point when a side of the door substantially abuts a side of the doorframe. The door can be prevented from sliding while door is swung open.

14 Claims, 19 Drawing Sheets

DOOR SYSTEMS AND METHODS

CROSS-REFERENCE TO RELATED APPLICATIONS

This application claims the benefit of U.S. Provisional Application No. 61/704,427, filed Sep. 21, 2012, the entirety of which is incorporated herein by reference.

BACKGROUND

1. Field

The present inventions relate to door systems and methods, and in particular, to a door system and method having a door that can both slide and pivot open.

2. Description of the Related Art

A conventional door opens by either sliding open or pivoting open. A door that slides to open provides the convenience of allowing the door to be used in small places, such as a narrow frozen food aisle in a supermarket, without interfering with walkways. However, these doors may be hard to stock with items, such as frozen foods. A door that pivots to open allows easy access for stocking of items, but may prevent mobility of users in a small space during, for example, shopping.

SUMMARY

A need exists to provide a door that can both slide open and pivot open. During routine use, the door can be slid open for utilization in a small space without interfering with walkways. During stocking of bulk/large items or other reasons requiring better access, the door can be swung open. The door can be positioned in a door frame. In one embodiment, the door can slide within the door frame using, for example, tracks, rollers, and/or guides. The door can be inhibited (e.g., prevented) from swinging open while the door is sliding along the doorframe. The door can swing open along a pivot point when a side of the door substantially abuts a side of the doorframe. The door can be inhibited (e.g., prevented) from sliding while door is swung open.

In some embodiments, a door system comprises a doorframe having a top frame, a bottom frame, a first side frame extending between the top frame and the bottom frame, and a second side frame extending between the top frame and the bottom frame, and the bottom frame including one or more sliding guides and one or more pivot guides. The door system further comprises one or more doors movably coupleable to the doorframe, each of the one or more doors having an upper end, a lower end, a first side extending between the upper end and the lower end, and a second side extending between the upper end and the lower end, the lower end of the door comprising a u-channel configured to slidably receive the one or more sliding guides therethrough as the door is slid from side to side relative to the doorframe, the u-channel having one or more cutouts on side surfaces thereof sized to allow the one or more sliding guides to pass through the one or more cutouts when the door is pivotably moved relative to the doorframe. The door system further comprises a carrier assembly coupled to each of the one or more doors and having a first end and a second end, the carrier assembly interposed between the upper end of the door and the top frame of the door frame, the carrier assembly configured to movably couple the door to the doorframe, the second end of the carrier assembly coupled to the upper end of the door proximate the second side of the door so as to provide a pivot point that at least partially defines a pivot axis of the door, the first end of the carrier assembly configured to releasably couple to the upper end of the door via a guide point assembly proximate the first side of the door so as to releasably lock the door in an orientation along a sliding plane defined by the doorframe. The carrier assembly can be configured to move between the first side frame and the second side frame, the door being configured to slide between the first side frame and the second side frame along with the carrier assembly such that the u-channel slides along the one or more sliding guides of the bottom frame. When the second side of the door and the second end of the carrier assembly substantially abut the second side frame, the one or more sliding guides of the bottom frame are generally aligned with the one or more cutouts of the u-channel, and one of the one or more pivot guides of the bottom frame at least partially engages a recess of the u-channel, thereby allowing the door to pivot out from the doorframe about the pivot axis, the door configured to separate from the carrier assembly at the guide point assembly.

In some embodiments, the guide point assembly connecting the door and the carrier assembly comprises a locking latch configured to inhibit the door from pivoting out from the doorframe when the second end of the carrier assembly does not substantially abut the second side frame. In some embodiments, the guide point assembly connecting the door and the carrier assembly comprises a ramp member formed in the carrier assembly and a bushing connected to the door, the bushing configured to slide onto the ramp to provide support for the door against the carrier assembly when the door is moved from a pivoting position outward from the doorframe to a sliding position co-planar with the sliding plane defined by the doorframe. In some embodiments, the door comprises a spring-loaded locking pin assembly configured to releasably engage an opening in the carrier assembly to inhibit the door from pivoting out from the doorframe, the locking pin being selectively actuatable to unlock the door from the carrier assembly so as to pivot the door outward from the doorframe. In some embodiments, the door comprises a handle frame positioned on the second side of the door, the handle frame configured to be substantially flush with the second side of the door, thereby allowing the door to pivot outward relative to the doorframe when the second side of the door is adjacent to the doorframe. In some embodiments, the one or more pivot guides of the bottom frame each comprise another sliding guide and a protrusion, the protrusion configured to engage the recess of the u-channel. In some embodiments, the carrier assembly comprises a locking lever assembly configured to inhibit the carrier assembly from sliding along the top frame when the door is pivoting out from the doorframe. In some embodiments, the carrier assembly comprises a roller assembly configured to roll within a track channel of the top frame of the doorframe between the first side frame and the second side frame. In some embodiments, the roller assembly comprises one or more roller wheels having ridges and the track channel comprises a c-channel, the c-channel configured to engage the ridges of the one or more roller wheels, the one or more roller wheels configured to maintain the position of the roller wheel within the c-channel. In some embodiments, the door system further comprises a counterweight assembly connected to the carrier assembly, the counterweight configured to bias the carrier assembly and the door to substantially abut the second side frame such that the door is biased in the closed sliding position.

In some embodiments, a door comprises a door movably coupleable to a doorframe, the door having an upper end, a lower end, a first side extending between the upper end and the lower end, and a second side extending between the upper end and the lower end, the lower end of the door comprising u-channel configured to slidably receive one or more sliding guides connected to the doorframe therethrough as the door is slid from side to side relative to the doorframe, the u-channel having one or more cutouts on side surfaces thereof sized to allow the one or more sliding guides to pass therethrough when the door is pivotably moved relative to the doorframe. The door system further comprises a carrier assembly having a first end and a second end, the carrier assembly configured to movably couple the upper end of the door to the doorframe, the carrier assembly releasably coupleable to the upper end of the door at a guide point assembly near the first side of the door, and the carrier assembly additionally coupled to the upper end of the door at a pivot point near the second side of the door. When the second side of the door substantially abuts a side of the doorframe, the one or more sliding guides connected to the doorframe are generally aligned with the one or more cutouts of the u-channel and one of the one or more pivot guides of the doorframe at least partially engages a recess of the u-channel such that the door can pivot out from the doorframe about a pivot axis defined by the pivot point and the pivot guide, the door configured to separate from the carrier assembly at the guide point assembly.

In some embodiments, the carrier assembly is coupled to a roller assembly, the roller assembly configured to roll within a track channel of the doorframe to allow the carrier assembly to slide from side to side relative to the doorframe, thereby moving the door from side to side relative to the doorframe such that the u-channel slides along the one or more sliding guides of the bottom frame. In some embodiments, the roller assembly comprises one or more roller wheels having ridges configured to engage a c-channel of the track channel such that roller assembly maintains substantially a same level position relative to the track assembly. In some embodiments, the carrier assembly comprises a locking lever assembly configured to engage the doorframe to inhibit the carrier assembly from sliding along the doorframe when the door is pivoting out from the doorframe. In some embodiments, the door is configured to release a spring-loaded locking lever of the locking lever assembly from the doorframe when the door is co-planar with a sliding plane defined by the doorframe, thereby allowing the carrier assembly to slide along the doorframe when the door is oriented along the sliding plane.

In some embodiments, a door comprises a door operably coupleable to a doorframe, the door having an upper end, a lower end, a first side extending between the upper end and the lower end, and a second side extending between the upper end and the lower end, the upper end of the door movably coupleable to the doorframe such that the door can slide along a sliding plane defined by the doorframe and so the door can pivot outward relative to the doorframe, the lower end of the door comprising a recess configured to slide over a bottom frame of the doorframe as the door is slid from side to side relative to the doorframe and to pivot about the doorframe as the door is pivotably moved relative to the doorframe. When the second side of the door substantially abuts a side of the doorframe, the upper end of the door is selectively movable relative to the doorframe near the first side of the door to allow the door to pivot out from the doorframe about at least the recess.

In some embodiments, the door further comprises a carrier assembly slidably coupling the upper end of the door to the doorframe, the carrier assembly pivotably coupled to the door at a pivot guide near the second side of the door, the pivot guide and the recess defining a pivot axis substantially along the second side of the door about which the door pivots. In some embodiments, the carrier assembly is releasably coupled to the door at a guide point assembly near the first side of the door, the guide point assembly configured to release the door when the second side of the door substantially abuts the side of the doorframe. In some embodiments, the guide point assembly comprises a bushing connected to the door, a locking latch coupled to the carrier assembly, and a ramp member formed in the carrier assembly, the ramp member configured to engage the bushing to provide support for the door against the carrier assembly when door is co-planar with the sliding plane defined by the doorframe, and the locking latch configured to inhibit the bushing from disengaging from the ramp member when the second side of the door does not substantially abut the side of the doorframe. In some embodiments, the lower end of the door is configured to slidably receive one or more sliding guides connected to the doorframe when the door is sliding relative to the doorframe such that the door is inhibited from pivoting out from the doorframe when the second side of the door does substantially abut the side of the doorframe. In some embodiments, the lower end of the door comprises one or more cutouts sized and positioned on the door such that the one or more sliding guides are configured to pass therethrough when the second side of the door substantially abuts the side of the doorframe.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter discussed herein will become apparent in the teachings set forth herein. The summary is provided to introduce a selection of concepts in a simplified form that are further described below in the Detailed Description. This summary is not intended to identify key features or essential features of any subject matter discussed herein.

BRIEF DESCRIPTION OF THE DRAWINGS

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally discussed herein, and illustrated in the Figures, may be arranged, substituted, combined, and designed in a wide variety of different configurations, all of which are explicitly contemplated and made part of this disclosure.

DETAILED DESCRIPTION

Figure 1:
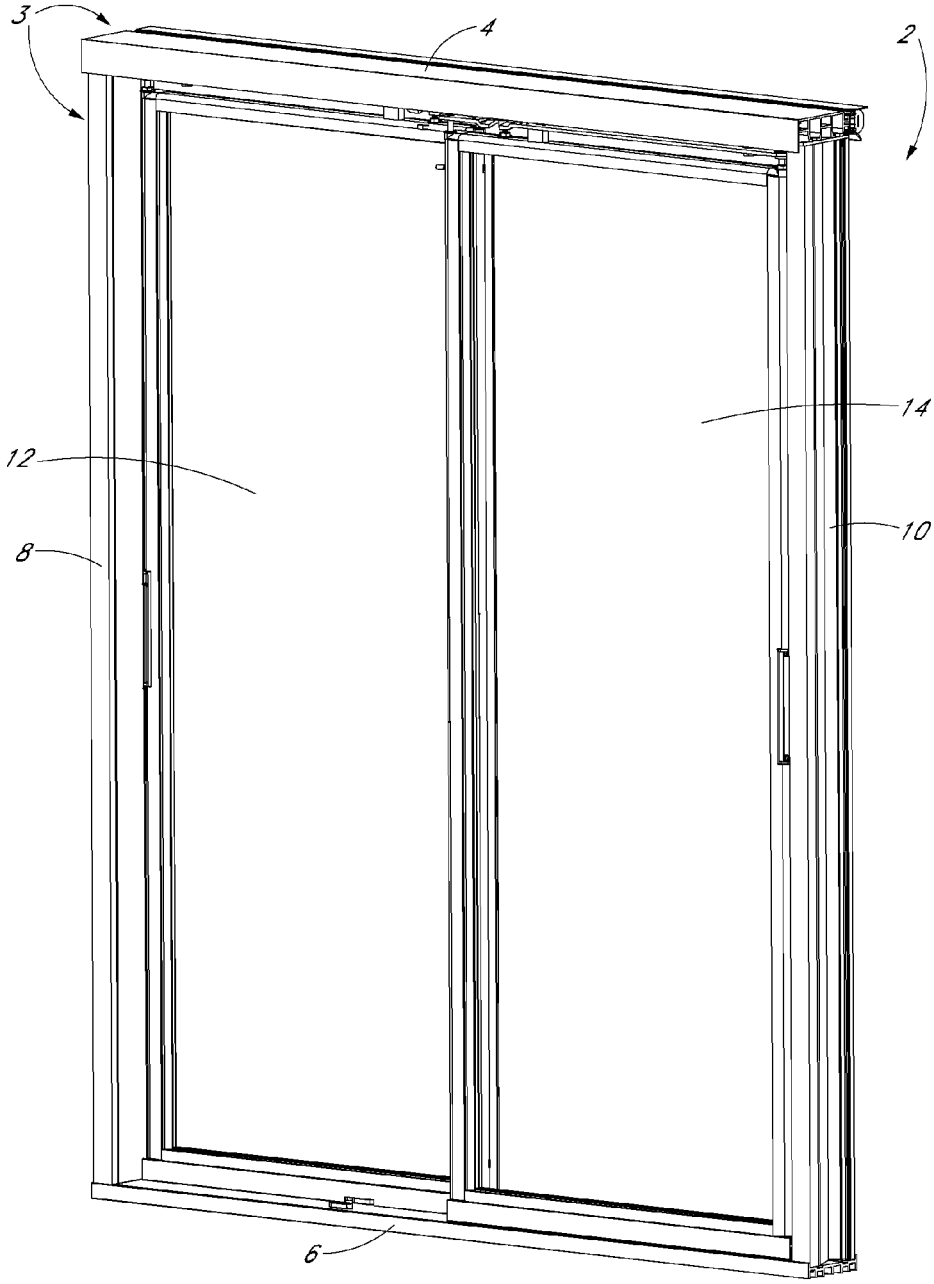
FIG. 1 shows a top perspective view of an embodiment of a door system.

FIG. 1 shows a perspective view of an embodiment of a door system 2. The door system 2 can have a doorframe 3. The doorframe 3 can have a top frame 4, a bottom frame 6, a first side frame 8 extending between the top frame 4 and the bottom frame 6, and a second side frame 10 extending between the top frame 4 and the bottom frame 6. In some embodiments, the door system 2 can have a first door 12 and a second door 14 that are positioned in the doorframe 3. In one embodiment, the door system 2 can be installed in commercial refrigerators, such as those used in supermarkets.

Figure 2:
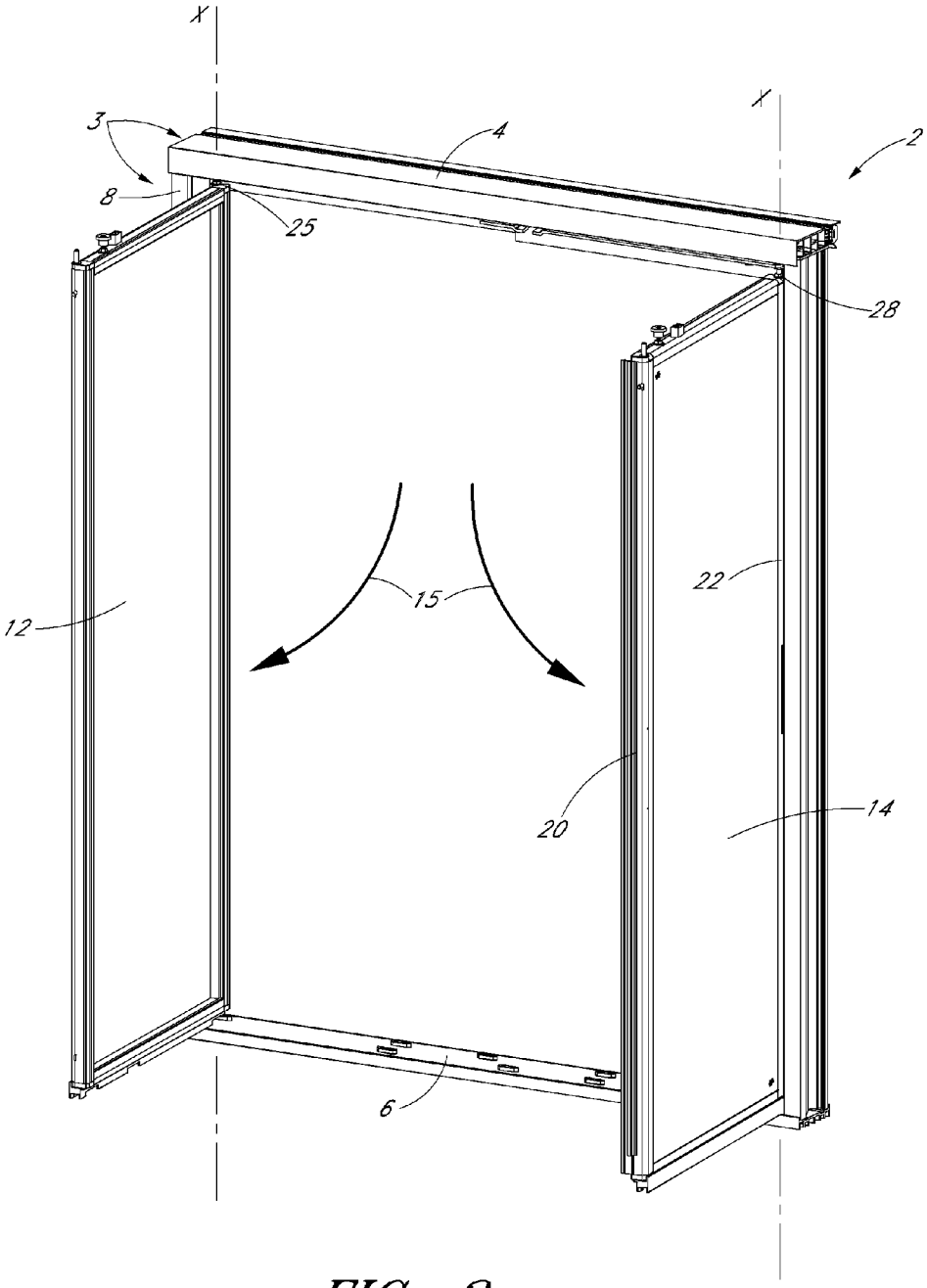
FIG. 2 shows a top perspective view of an embodiment of doors pivoting out from the doorframe.

FIG. 2 shows a perspective view of an embodiment of the first door 12 and the second door 14 pivoting out from the doorframe 3 along the path shown by arrows 15. The first door 12 and the second door 14 pivot about a pivot point 25 and a pivot point 28, respectively. The pivot points 25, 28 at least partially define an axis of rotation X for the doors 12, 14. The pivoting action of the doors 12, 14 will be discussed in further detail herein.

Figure 3:
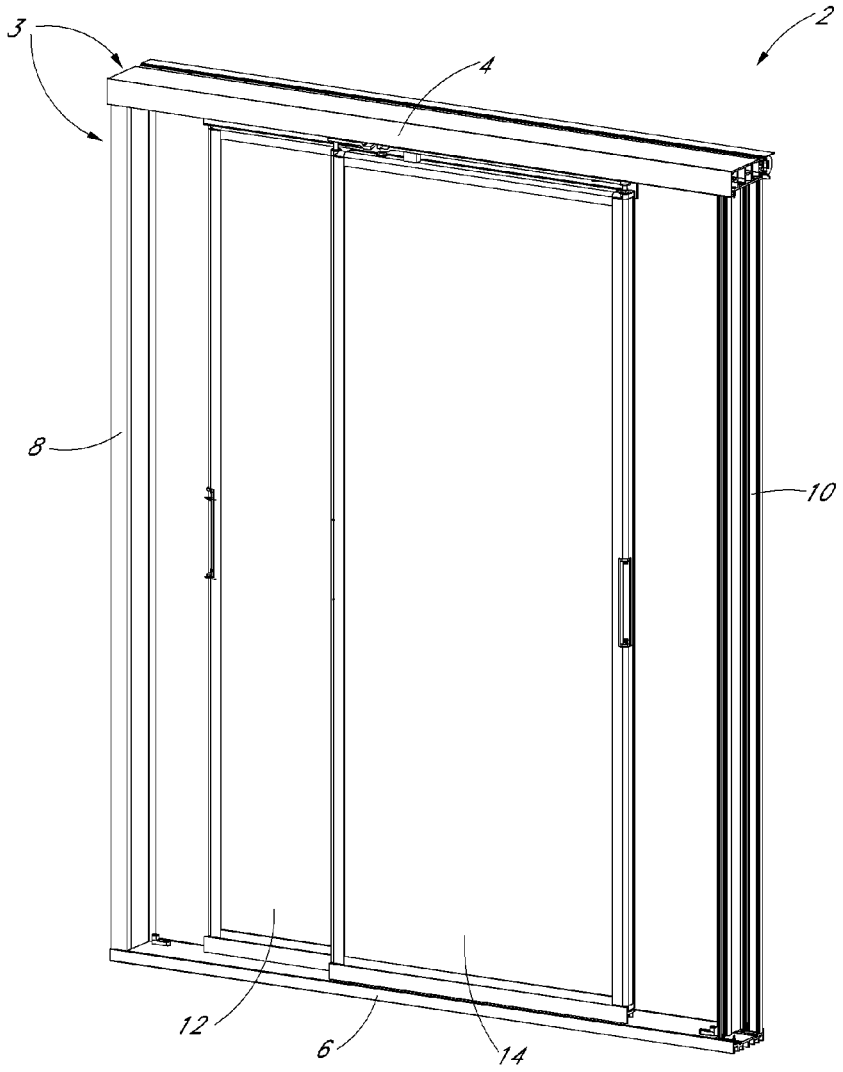
FIG. 3 illustrates a top perspective view of an embodiment of the doors sliding along a sliding plane.

FIG. 3 illustrates a perspective view of an embodiment of the first door 12 and the second door 14 sliding along a sliding plane of the doorframe 3. The sliding plane is formed along the top frame 4 and the bottom end 6. In one embodiment, each of the doors 12, 14 can be shorter in width (or a length along the top frame 4) than the width (or a length along the top frame 4) of the doorframe 3. In another embodiment, the combined width of the doors 12, 14 can be approximately equal to the width of the doorframe 3. In still another embodiment, the combined width of the doors 12, 14 can be greater to the width of the doorframe 3. As shown in FIG. 3, the doors 12, 14 can move (e.g. slide) along parallel planes so that the first door 12 moves (e.g., slides) along a plane behind the second door 14. The sliding action of the doors 12, 14 will be discussed in further detail herein.

Figure 4:
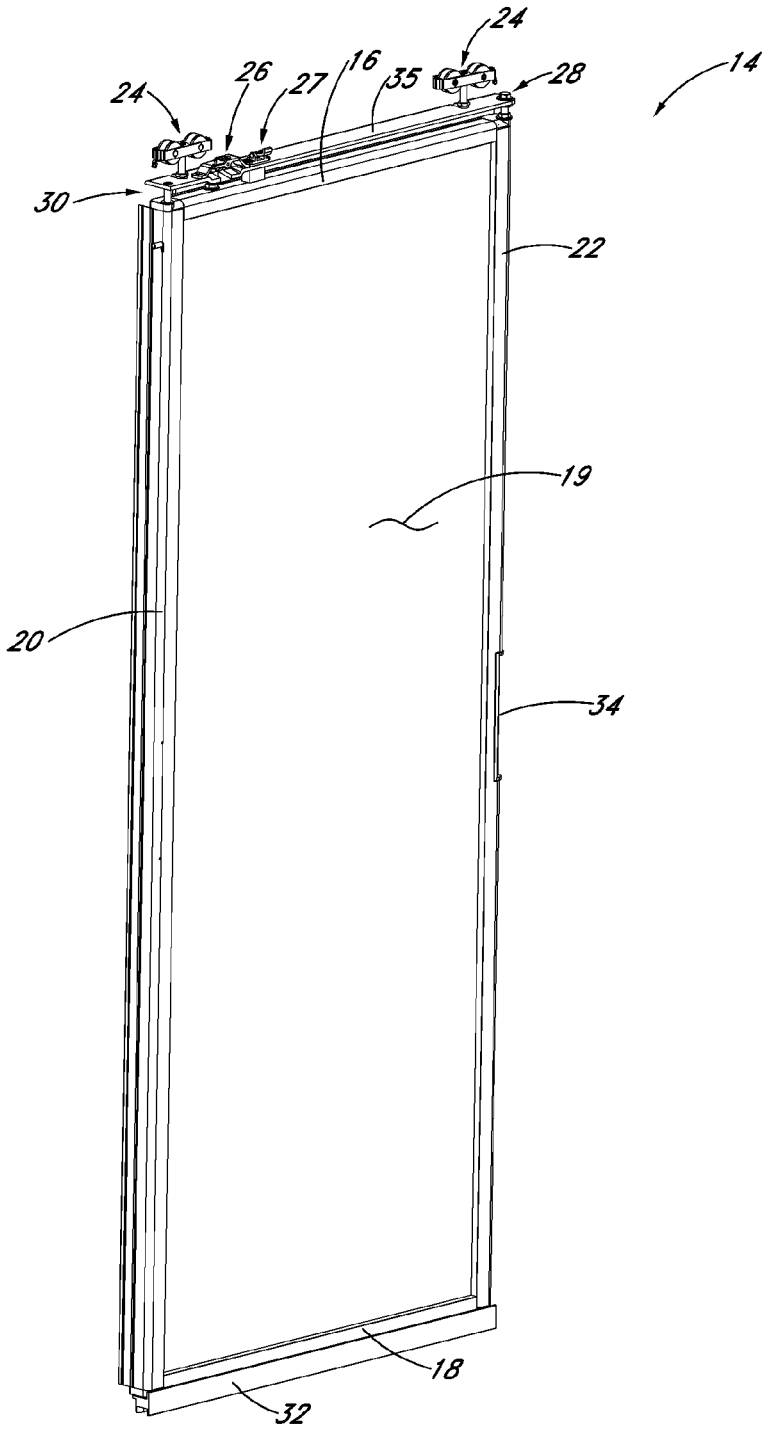
FIG. 4 shows a top perspective view of an embodiment a door.

FIG. 4 shows a perspective view of an embodiment of the second door 14. The door 14 can have an upper end 16, a lower end 18, a first side 20 extending between the upper end 16 and the lower end 18, and a second side 22 extending between the upper 16 end and the lower end 18. The door 14 can have a body or glass 19 housed within the upper end 16, the lower end 18, the first side 20, and the second side 22. The door 14 can have a u-channel 32 attached to or incorporated into the lower end 18 for sliding along the bottom frame 6, as discussed further below. The door 14 can be coupled to a carrier assembly 35, which can have a roller assembly 24, a guide point assembly 26, a locking lever assembly 27, a pivot point 28, and a locking pin assembly 30, which are described in further detail herein. The door 14 can have a handle 34 that is substantially flush with the second side 22 of the door 14 so that the handle 34 does not protrude from the second side 22 of the door. In one embodiment, the handle 34 can be a recessed portion in the second side 22 of the door 14. In use, the handle 34 can be sized to receive one or more of a user's fingers and allow the user to push the handle 34 to slide the door 14 along the sliding plane as illustrated in FIG. 3. In some embodiments, another handle can be provided on the first side 20 to aid the user in swinging and/or sliding the door 14 open.

Figure 5:
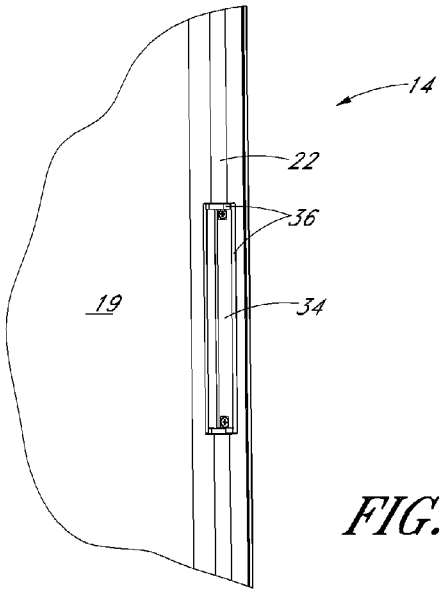
FIG. 5 shows a perspective view of an embodiment of a handle of the door.

FIG. 5 shows a perspective view of an embodiment of the handle 34. The handle 34 can be formed in the second side 22 of the door 14. The shape of the handle can be cut out from the second side 22. The handle 34 can have a frame 36 that is attached to the door 14 to form the handle 34. The frame 36 of the handle 34 can be substantially flush with second side 22 such that the frame 36 of the handle 34 does not interfere with the second side frame 10 when the door 14 is swung open about the pivot axis defined at least in part by the pivot point 28 between the door 14 and carrier assembly 35.

Figure 6:
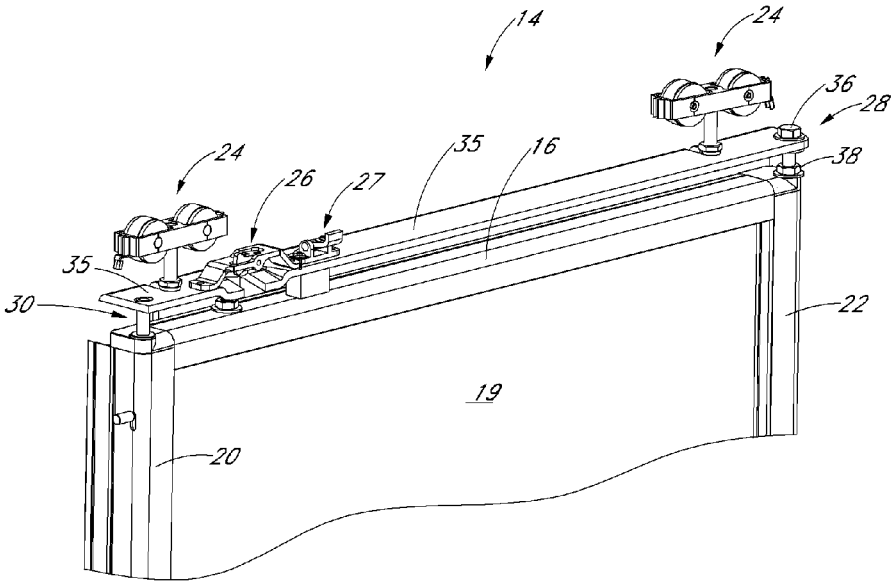
FIG. 6 shows a perspective top view of an embodiment of a top end of the door.

FIG. 6 shows a perspective view of an embodiment of the top end 16 of the door 14. The top end 16 can have a carrier (or a carrier assembly) 35, a roller assembly 24 connected to the carrier 35, a guide point assembly 26, a pivot point 28 for pivoting as illustrated in FIG. 2, and/or a locking level assembly 27, and/or a lock pin assembly 30. The pivot point 28 can be formed from a bolt 36 and a nut 38 connecting the door 14 to the carrier 35, though other suitable mechanisms can be used for the pivot point 28 (e.g., a spring loaded pin that extends through a hole in the carrier 35). The guide point assembly 26 can support the door 14 and prevent the door 14 from swinging out from the doorframe 3 during sliding along the sliding plane. The door 14 can have a roller assembly 24 connected to the carrier 35, which connects to the upper end 16, where the roller assembly 24 can have one or more wheels that travel within a track attached to or incorporated in the top frame 4 of the doorframe 3. The roller assembly 24 can facilitate the sliding action of the door 14 as described herein. The guide point assembly 26 can release the door 14 at the location of the guide point assembly 26, allowing the door to swing out of the doorframe 3 about the pivot point 28 when the second side 22 substantially abuts the second side fame 10 as illustrated in FIG. 2. The locking lever assembly 27 can prevent the carrier 35 from sliding along the sliding plane when the door 14 is swinging out from the doorframe 3, thereby advantageously maintaining the carrier 35 in a fixed position while the door 14 is swung open and inhibiting the sliding of the carrier 35 (and therefore the pivot point 28) along the sliding plane while the door 14 is swung open. The lock pin assembly 30 can additionally inhibit the door 14 from swinging out from the doorframe 3 unless the lock pin assembly 30 is disengaged from the carrier 35 as described herein.

Figure 7:
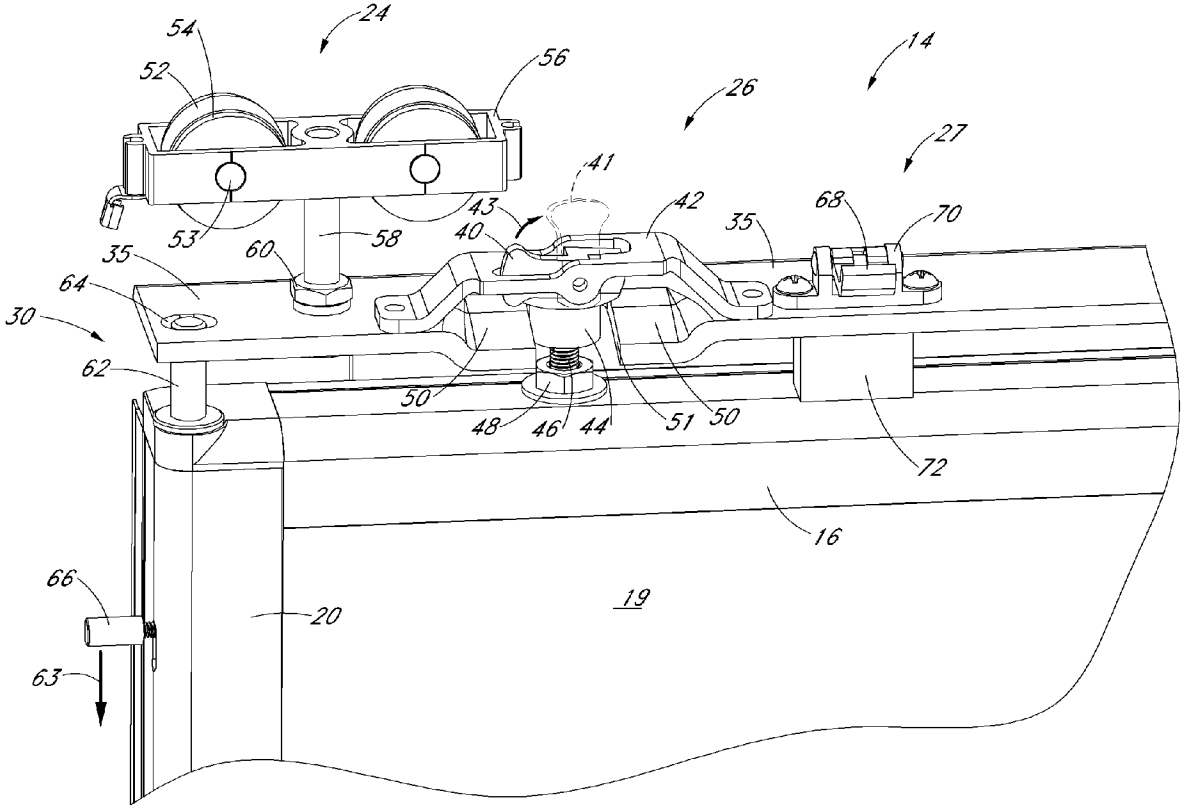
FIG. 7 shows another perspective view of an embodiment of the top end of the door.

FIG. 7 shows a perspective view of an embodiment of the roller assembly 24, the guide point assembly 26, the locking lever assembly 27, and the locking pin assembly 30. The roller assembly 24 can be connected to the carrier 35 with a bolt 58 and a nut 60. The roller assembly 24 can have one or more roller wheels 52 engaging a wheel housing 56 about an axle 53. The roller wheels 52 can have ridges 54 that maintain the roller wheel alignment as described further herein. Though not shown in FIG. 7, the roller wheels 52 travel along a track attached to or incorporated in the top frame 4 of the doorframe 3.

The guide point assembly 26 can have a locking latch 40 connected to the carrier 35 by a bracket 42. The guide point assembly 26 can have a bushing 44 that is connected to the door with a bolt 46 and a nut 48. When the door 14 is not pivoting about the pivot point 28 and is in the closed position relative to the door frame 3 (e.g., so as to be able to slide the door 14 in the frame 3), the bushing 44 engages a bushing channel 51 on the carrier 35. The bushing 44 can slide past the locking latch 40 into the bushing channel 51. The locking latch 40 can have an elongate body such that when the locking latch 40 is in a generally horizontal position, the bushing 44 can move in and out of the bushing channel 51 and past the locking latch 40. The locking latch 40 can be spring-loaded to be biased toward a vertical position as illustrated by arrow 43. When the locking latch 40 is in the vertical position, the vertically-oriented elongate body 41 (illustrated by dashed lines) inhibits (e.g., prevents) the bushing 44 from exiting the bushing channel 51. In some embodiments, the locking latch 40 is pushed into the horizontal position by a locking latch block 76 as described in reference to FIG. 9. Therefore, when the door 14 is adjacent the second side frame 10 of the doorframe 3, said locking latch block 76 can bear against the locking latch 40 to position the latch 40 in the generally horizontal position, thereby allowing the bushing 44 to exit the bushing channel 51 when the locking pin 30 is actuated to decouple the door 14 from the carrier 35 to allow the door 14 to be swung open relative to the doorframe 3. When the door 14 is subsequently pivoted back to the closed position, and the locking pin 30 engaged to the carrier 35, as the door 14 is slid relative to the doorframe 3 the locking latch block 76 disengages from the locking latch 40, allowing the spring-loaded latch 40 to rotate to the generally vertical position, thereby inhibiting the bushing 44 from exiting the bushing channel 51 so as to further inhibit the door 14 from being swung open while the door is sliding within the door frame 3. The locking pin assembly 30 can act as a safety mechanism, preventing the door 14 from swinging out from the doorframe 3 when the locking latch 40 is in the vertical position. Even if the locking pin 30 is actuated to decouple the door 14 from the carrier assembly 35 when sliding the door 14 open relative to the doorframe 3, the locking latch 40 inhibits the door 14 from being swung open by blocking the bushing 44 from exiting the bushing channel 51.

The locking pin assembly 30 can have a locking pin 62 that engages the carrier 35 through a locking hole (or opening) 64. The locking pin assembly 30 can have a knob, lever, or manual actuator 66 connected to the locking pin 62. The knob 66 can be pulled down by a user as illustrated by arrow 63 to disengage the locking pin 62 from the locking hole (or opening) 64. The locking pin assembly 30 can be spring biased to vertically push up the locking pin 62 and engage the locking hole 64 when the knob 66 is not being pulled down. The locking pin assembly 30 can act as another safety mechanism, preventing the door 14 from swinging out from the doorframe 3 when the locking pin 62 is engaged with the locking hole 64.

Figure 8A:
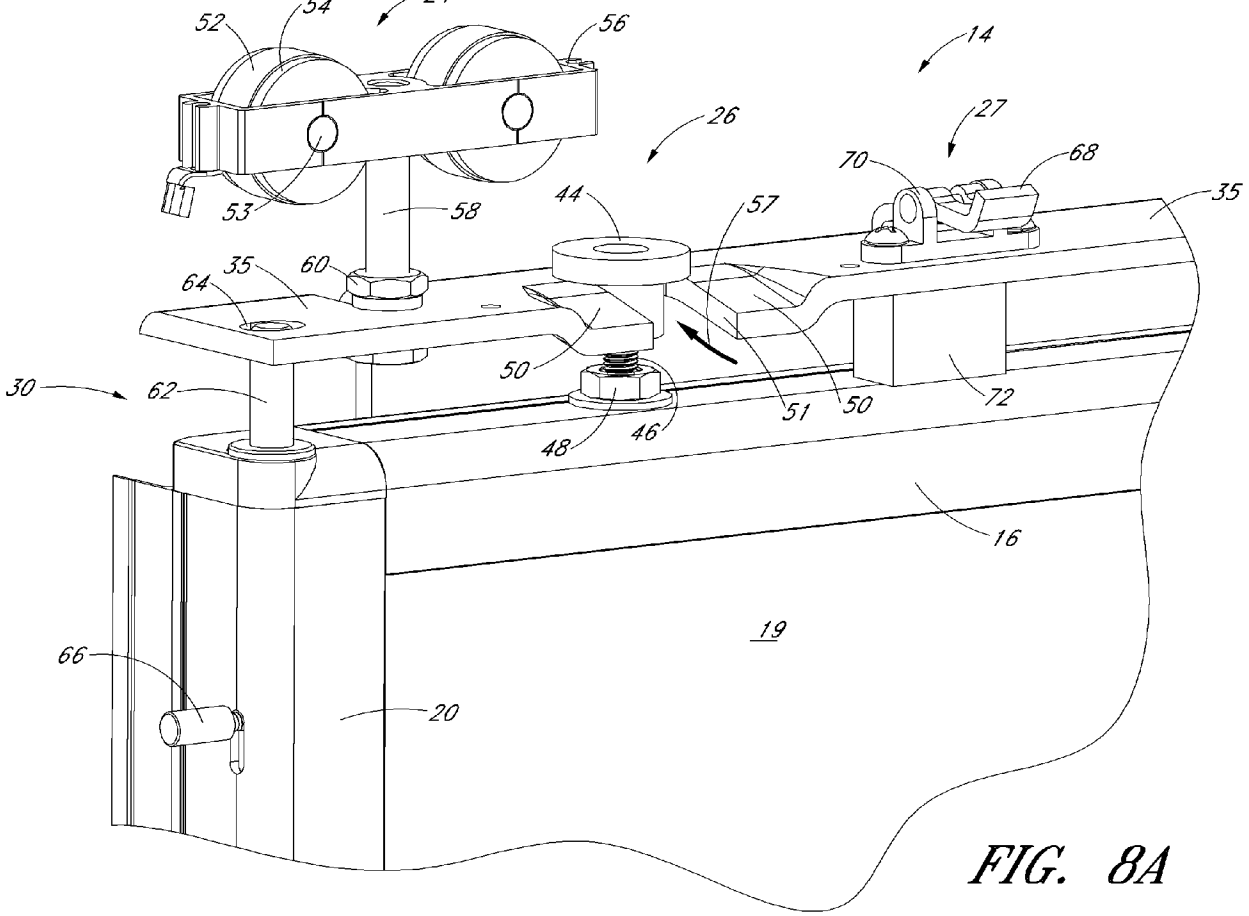
FIG. 8A shows yet another perspective view of an embodiment of the top end of the door.

FIG. 8A shows a perspective view of an embodiment of the guide point assembly 26 with the locking latch 40 and the bracket 42 (see FIG. 7) removed for illustration purposes. The bushing channel 51 can be formed with ramps 50 from the carrier 35. The ramps 50 can engage the bushing 44 in a friction fit when the door 14 is swung back into the closed position as illustrated by arrow 57 such that the bushing 44 rides up the ramps 50 and rests against the carrier 35 when the door is closed. The interference fit can act as a support for the door 14 against the carrier 35 when the door 14 is in the closed position and/or being slid open relative to the doorframe 3.

Figure 8B:
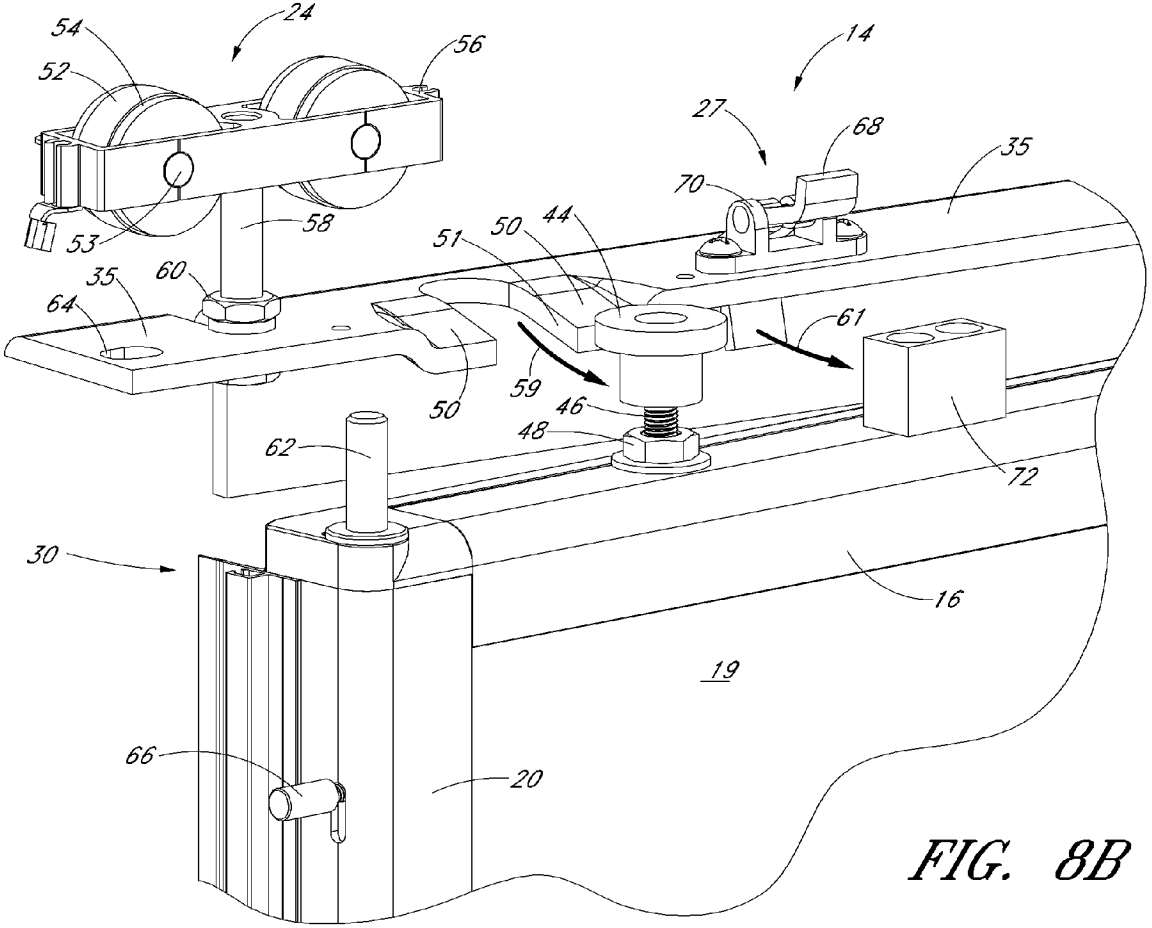
FIG. 8B shows a perspective view of an embodiment of the top end of the door as the door is swung open.

FIG. 8B shows a perspective view of an embodiment of the guide point assembly 26 with the locking latch 40 and the bracket 42 (see FIG. 7) removed for illustration purposes. FIG. 8B illustrates the door 14 being swung open when the locking latch 40 is in the horizontal position 41 (see FIG. 7) as discussed herein, and in particular reference to FIGS. 7, 9, and 10. Prior to swinging the door 14 open, the second end 22 of the door 14 can abut the second side frame 10 as discussed herein. The knob 66 of the locking pin assembly 30 can be pulled down to disengage the locking pin 62 from the locking hole 64 as discussed herein. As the door 14 is swung open, the bushing 44 slides off the ramps 50 and disengages from the bushing channel 51 as illustrated by arrow 59, allowing the door 14 swing about axis X of the pivot point 28 and pivot guide 96 as discussed herein. FIG. 8B also illustrates how the swinging action of the door 14 can separate the door block 72 from the locking lever 68 as illustrated by arrow 61 such that the locking lever 68, which can be spring-loaded, engages with the top frame 4 as discussed herein, and in particular reference to FIGS. 9 and 10.

Figure 9:
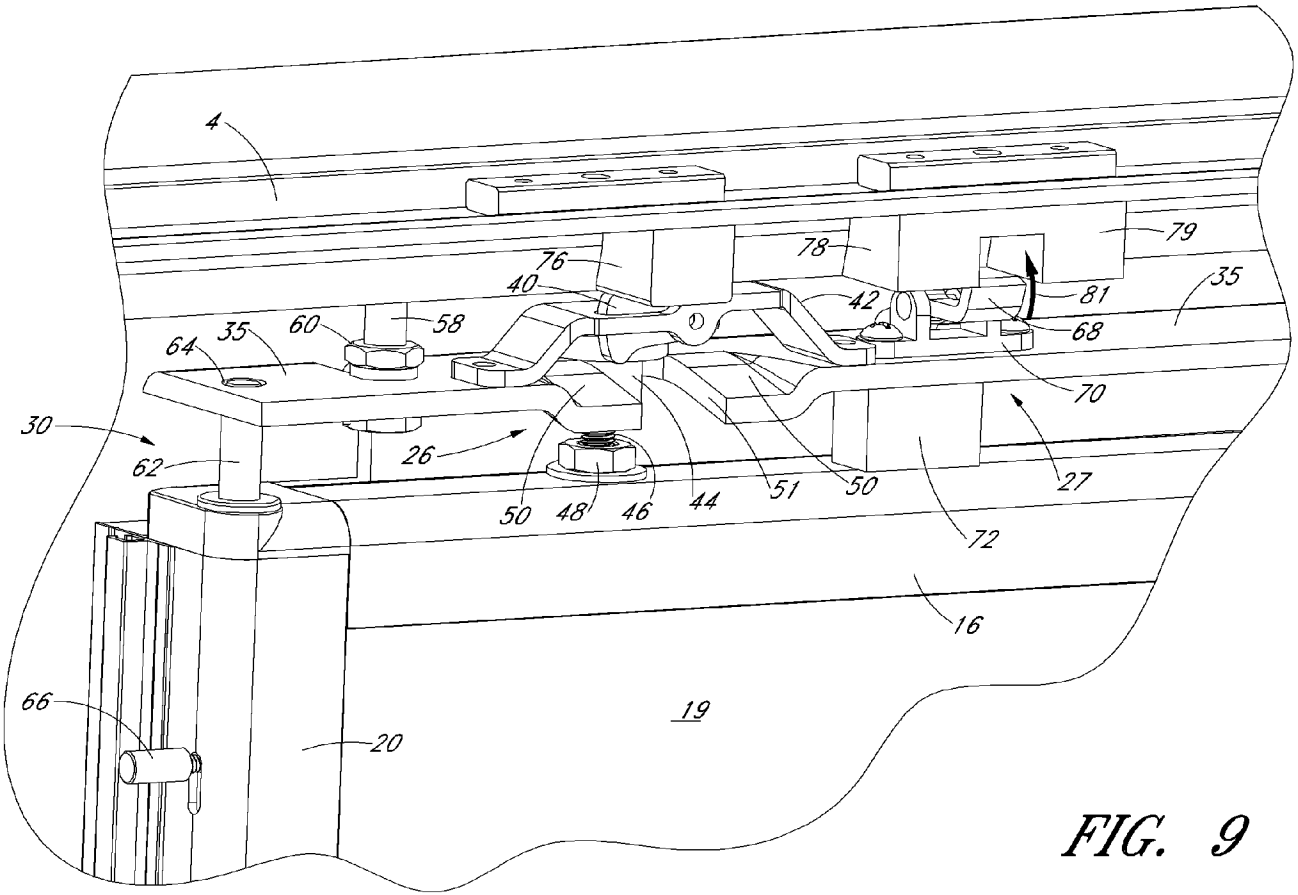
FIG. 9 shows a perspective view of an embodiment of the door in its closed state positioned within a top end of the doorframe.

FIG. 9 shows a perspective view of an embodiment of the door 14 in its closed state positioned within the top frame 4 (e.g., the door 14 disposed adjacent the second side frame 10 of the doorframe 3). The top frame 4 can have locking latch block 76 and a locking lever block 78. As illustrated in FIG. 9, the locking latch block 76 can be connected to the top frame 4 such that the locking latch block 76 pushes or bears against, or otherwise contacts, the locking latch 40 when the second side 22 of the door 14 substantially abuts the second side frame 10 so as to move the locking latch 40 to the generally horizontal position. When the locking latch 40 is in the generally horizontal position, the bushing 44 can be disengaged from the bushing channel 51 for the door 14 to swing open.

As also illustrated in FIG. 9, the locking lever block 78 can be connected to the top frame 4 such that a locking lever 68 of the locking lever assembly 27 engages (e.g., extends into) a recess 79 of the locking lever block 78 when the second side 22 of the door 14 substantially abuts the second side frame 10 and the door is pivoted open away from the door frame 3. When the locking lever 68 engages with the recess 79, the locking lever 68 can prevent the carrier 35 from sliding along the top frame 4 while the door 14 is swung open, thereby inhibiting the door 14 from sliding while the door 14 is swung open. The locking lever 68 can be spring biased to swing up in the direction of the locking lever block 78 as illustrated by arrow 81. The locking lever 68 can be pushed away from the recess 79 by the door block 72 as shown discussed in reference to FIG. 10, thereby allowing the carrier 35 and door 14 to slide along the doorframe 3.

Figure 10:
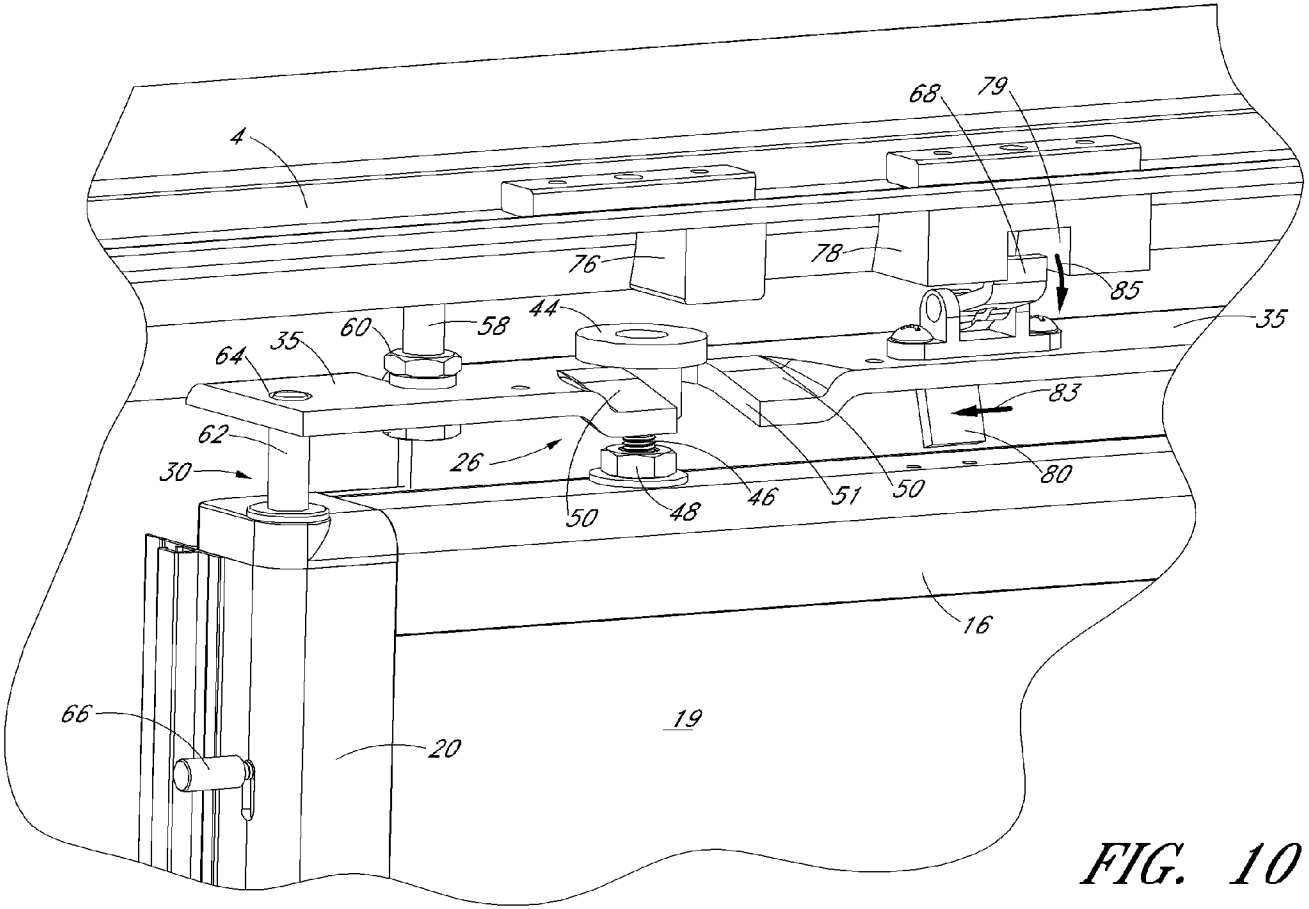
FIG. 10 shows another perspective view of an embodiment of the door in its closed state positioned within a top end of the doorframe.

FIG. 10 shows a perspective view of the door 14 in its closed state positioned within the top frame 4 without the door block 72 for illustration purposes. The locking lever 68 can have a releasing end 80. When the releasing end 80 is pushed by the door block 72 (see FIG. 9) as illustrated by arrow 83, the locking lever 68 is moved downward (about its pivot point), away from the recess 79 as illustrated by arrow 85, such that the carrier 35 can slide along the top frame 4. Therefore, when the door 14 is swung open, the locking lever 68 moves into engagement with the recess 79 of the locking lever block 78 (e.g., via a spring biasing force in the locking lever assembly). Additionally, when the door 14 is swung back to the closed position, the door block 72 pushes against the releasing end 80 of the locking lever 68, which in turn disengages the locking lever 68 from the recess 79 in the locking lever block 78, thereby allowing the door 14 to slide within the door frame 3.

Figure 11:
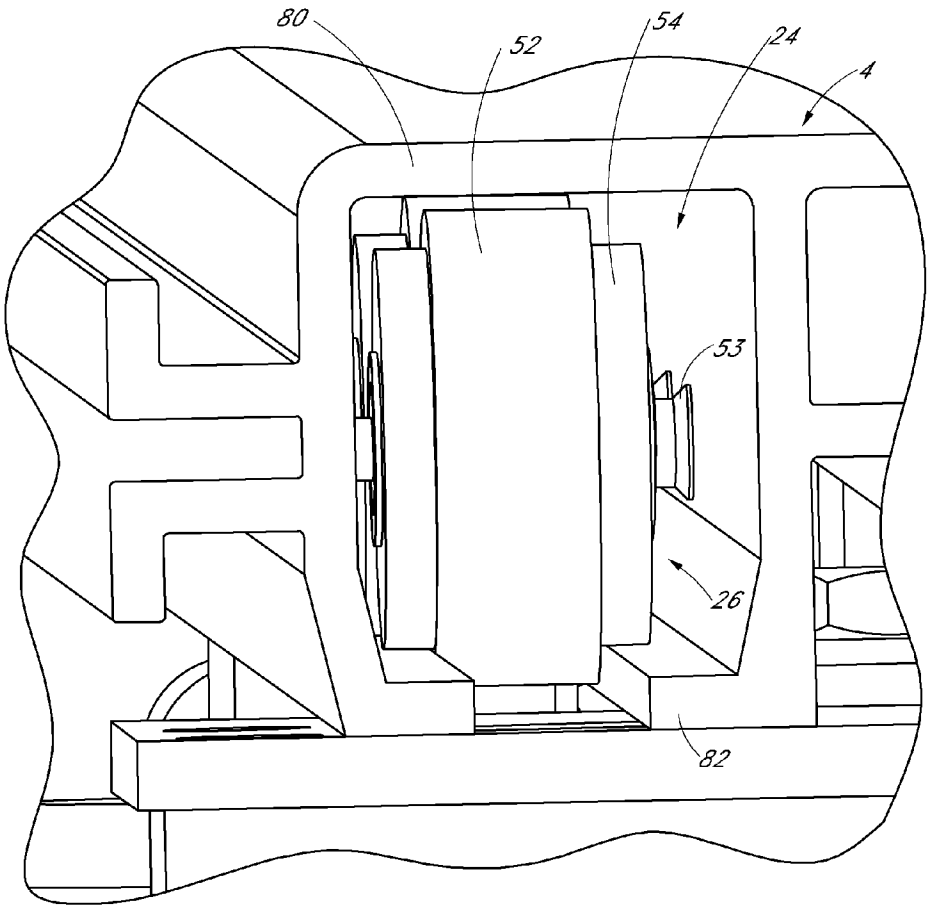
FIG. 11 shows a perspective view of an embodiment of roller wheels engaged with the top end.

FIG. 11 shows a perspective view of an embodiment of the roller wheels 52 engaged with the top end 4. The top end 4 can have a c-channel 80 with bottom guides 82, which form a track. The ridges 54 of the roller wheels 52 roll along the bottom guides 82, providing two support points for the roller wheels 52 to maintain position of the roller assembly 24 through the c-channel 80 or track as the wheels roll along the track (e.g., as the door 14 is slid open relative to the doorframe 3).

Figure 12:
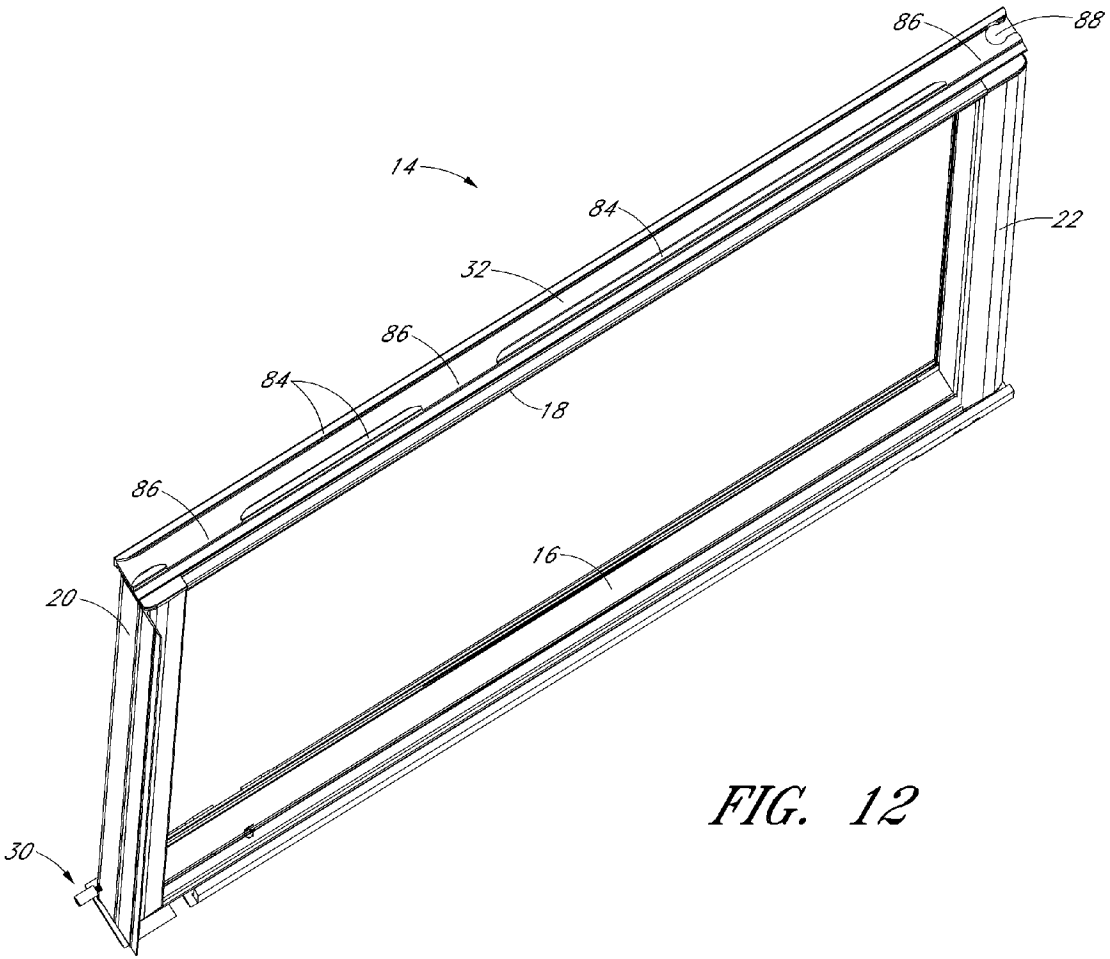
FIG. 12 shows a bottom perspective view of an embodiment of a lower end of the door.
Figure 13:
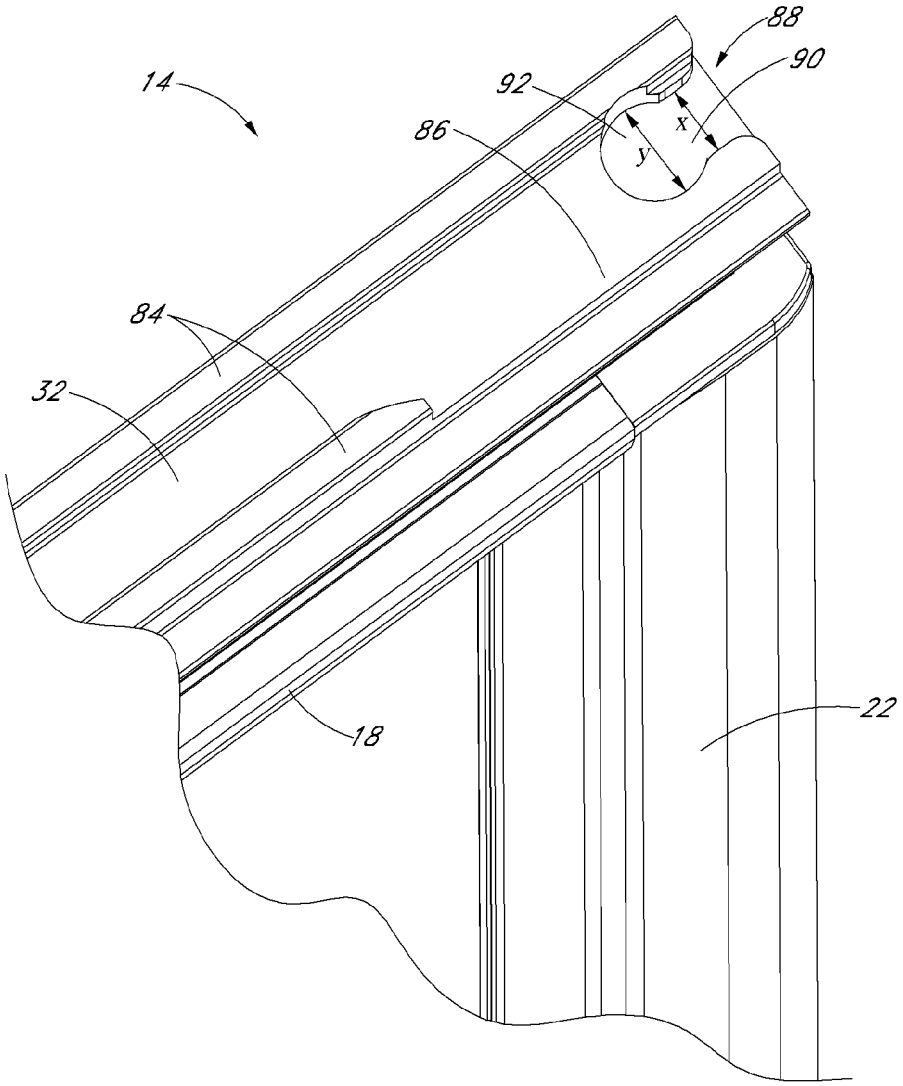
FIG. 13 shows another bottom perspective view of an embodiment of a lower end of the door.

FIG. 12 shows a perspective view of an embodiment of the lower end 18 of the door 14 with the u-channel 32. The u-channel 32 can have side ridges 84. The ridges 84 can have spaces or cutouts 86. In some embodiments, the spaces or cutouts 86 are on both sides of the u-channel 32 to allow the door 14 to pivot in two directions relative to the doorframe 3. In some embodiments, the spaces or cutouts 86 are on one side of the u-channel 32 to allow the door 14 to pivot in one direction, but prevent the door 14 from pivoting in the other direction relative to the doorframe 3. The u-channel 32 can have a recess 88 on an end of the door 14 that abuts against the second side frame 10 of the doorframe 3. FIG. 13 shows a perspective view of an embodiment of the recess 88. The recess 88 can have a narrow entrance portion 90 with a dimension X and a relatively wider body portion 92 with a dimension Y.

Figure 14:
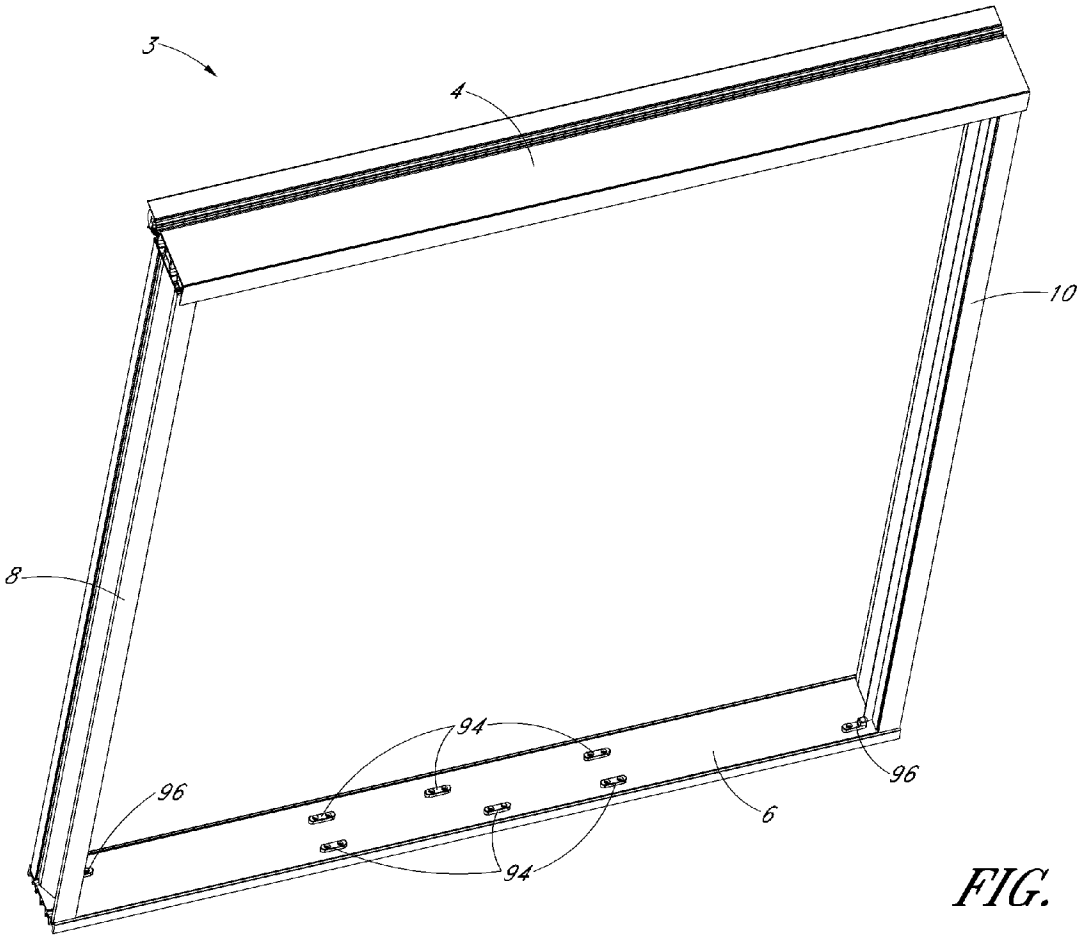
FIG. 14 shows a top perspective view of an embodiment of the doorframe.

FIG. 14 shows a perspective view of an embodiment of the doorframe 3. The bottom frame 6 can have one or more slide guides 94 disposed along a sliding plane of the doors 12, 14. The bottom frame 6 can have pivot guides 96 adjacent the first and second side frames 8, 10 that the doors 12, 14 abut against when the doors 12, 14 are closed, where the pivot guides 96 define along with the pivot points 25, 28, the pivot axes X about which the doors 12, 14 can be swung open. The slide guides 94 and the pivot guides 96 can be positioned on the bottom frame 6 to allow the doors 12, 14 to slide along the sliding plane.

Figure 15:
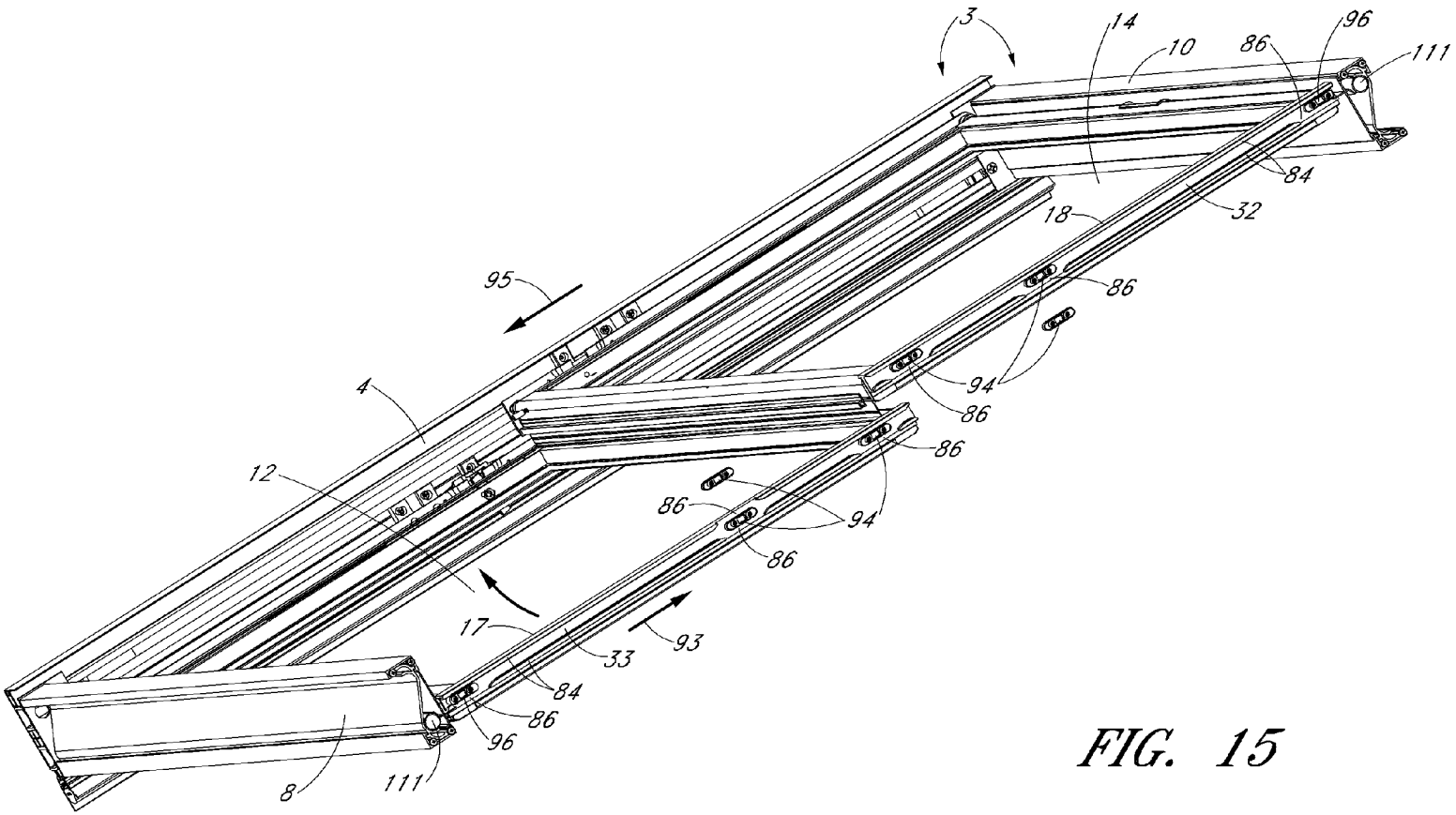
FIG. 15 shows a bottom perspective view of an embodiment of lower ends of the doors.

FIG. 15 shows a perspective view of an embodiment of a lower end 17 of the first door 12 and the lower end 18 of the second door 14. The slide guides 94 and the pivot guides 96 are show suspended because the bottom frame 6 is removed for illustration purposes. As the first door 12 slides along the direction illustrated by arrow 93, a u-channel 33 of the first door 12 can engage the slide guides 94 to maintain the position of the first door 12 within the doorframe 3 sliding plane. Similarly, as the second door 14 slides along the direction illustrated by arrow 95, the u-channel 32 can engage the slide guides 94 to maintain the position of the second door 14 within the doorframe 3 sliding plane. With continued reference to FIG. 15, when the doors 12, 14 are in the closed position relative to the doorframe 3, the slide guides 94 generally align with openings or cutouts 86 in the u-channel 32, which allows the slide guides 94 to pass through the openings 86 when the doors 12, 14 are swung open away from the doorframe 3. In some embodiments, the u-channel 33 of the first door 12 has openings 86 on both sides of the u-channel positioned and sized such that the openings 86 of the second door 12 can clear the slide guides of both doors 12, 14 as illustrated by arrow 97.

Figure 16:
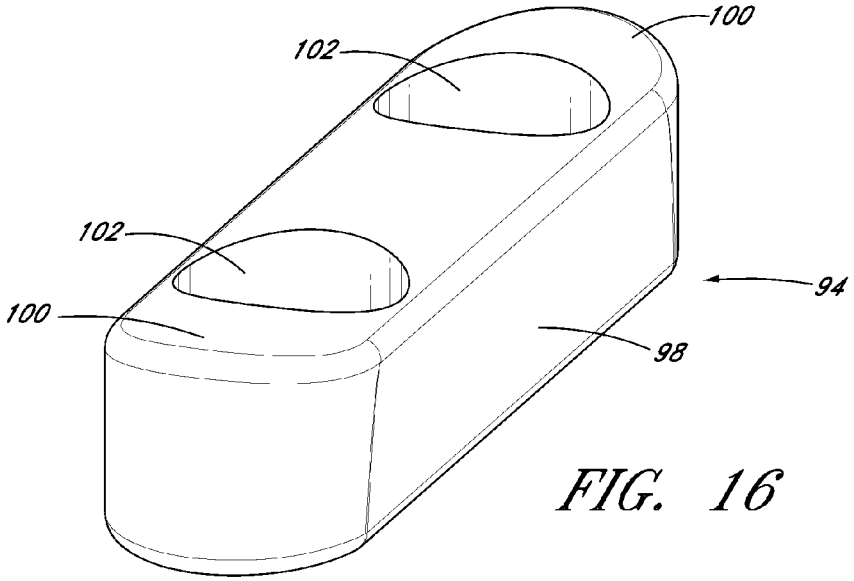
FIG. 16 shows a perspective view of an embodiment of a slide guide.

FIG. 16 shows a perspective view of an embodiment of a slide guide 94. The slide guide 94 can have an elongated body 98 and rounded ends 100 to facilitate the sliding of the u-channel 32 along the bottom frame 6. The slide guide 94 can have holes 102 for connecting the slide guide 94 to the bottom frame 6.

Figure 17:
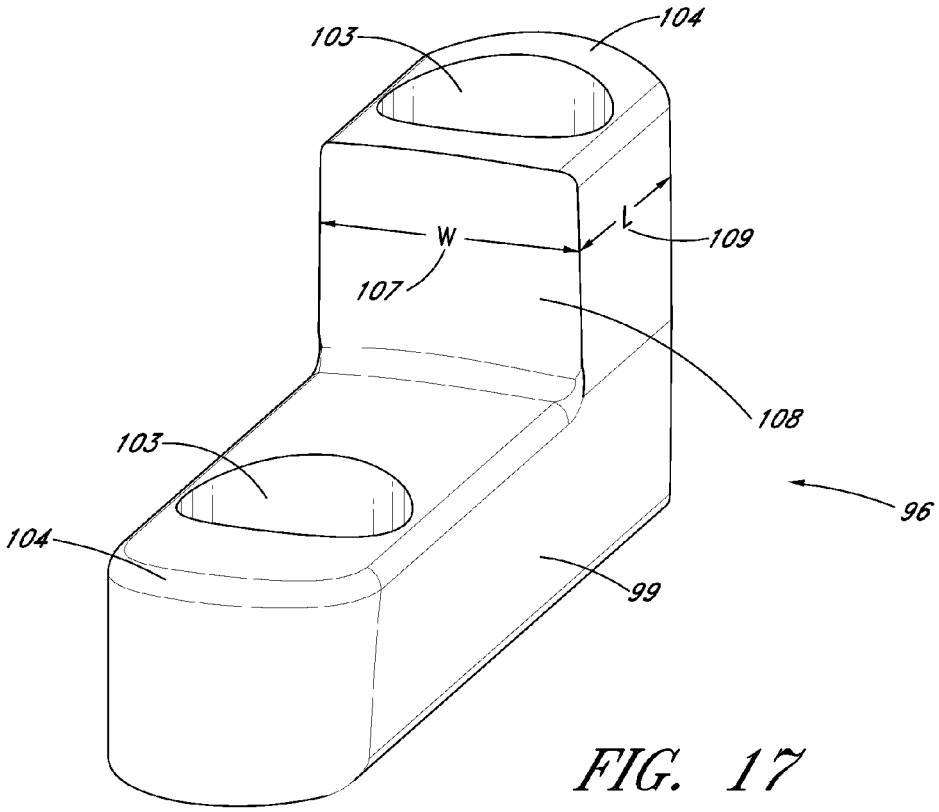
FIG. 17 shows a perspective view of an embodiment of a pivot guide.

FIG. 17 shows a perspective view of an embodiment of a pivot guide 96. The pivot guide 96 can have an elongated body 99 and rounded ends 104 to facilitate the sliding of the u-channel 32 along the doorframe 3. The pivot guide 96 can have holes 103 for connecting the pivot guide 96 to the bottom frame 6. The pivot guide 96 can have a protrusion 108 for engaging the recess 88 of the u-channel 32. In one embodiment, the protrusion 108 can have a width W 107 that is substantially equal to or shorter than the dimension X of the entrance portion 90 of the recess 88 as illustrated in FIG. 13. The protrusion 108 can have a length L 109 that is longer than the dimension X, but substantially equal to or shorter than the dimension Y of the body portion 92 of the recess 88. When the second end 22 of the door 14 abuts the second side frame 10, the protrusion 108 can enter the recess 88 through the entrance portion 90. When the length L 109 of the protrusion 108 is substantially equal to or shorter than the dimension Y of the body portion 92, the door 14 can pivot about the protrusion 108. The engagement between the protrusion 108 and the recess 88 acts as a pivot point for the door 14 (which together with the pivot point 28 defines a pivot axis) such that the pivot point does not move or is not pulled away from the doorframe 3 when the door 14 is being swung open. The protrusion 108 is locked into the recess 88 once the door 14 swung open.

Figure 18:
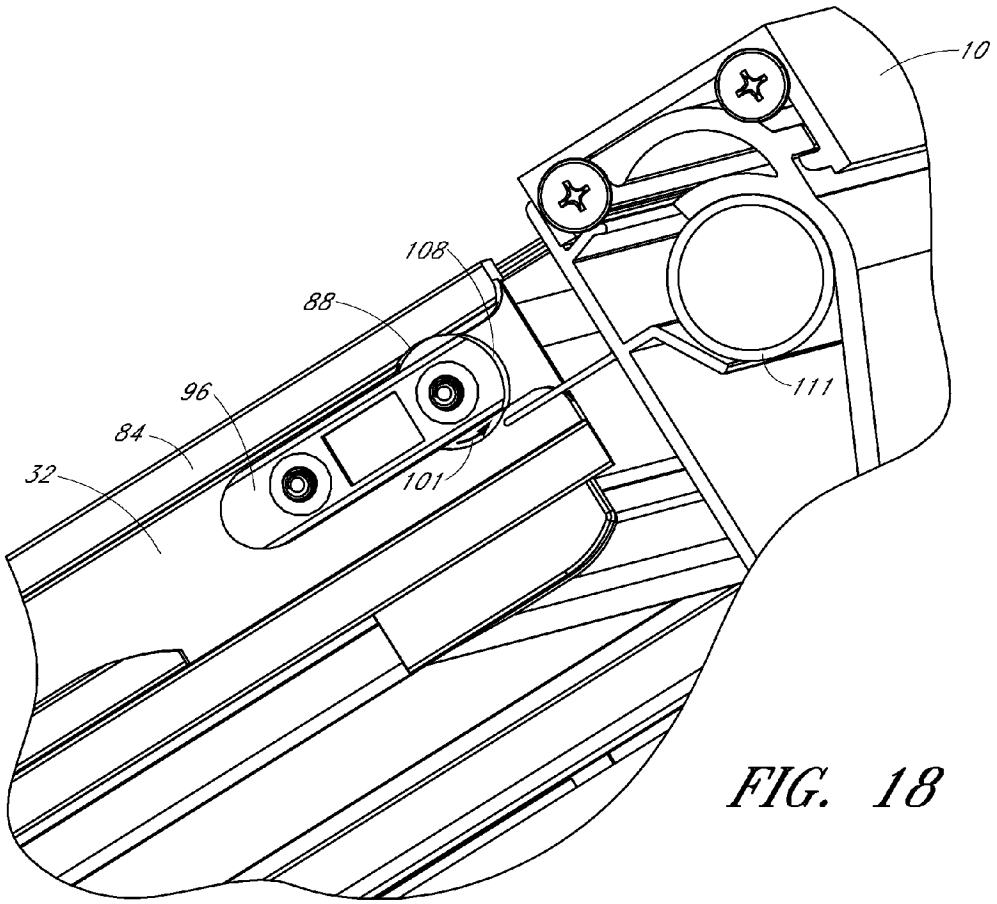
FIG. 18 shows a perspective view of an embodiment of a pivot guide engaged with the recess of the door.

FIG. 18 shows a bottom perspective view of an embodiment of a pivot guide 96 engaged with the recess 88 of the u-channel 32 of the door lower end 18. FIG. 18 illustrates that the width W 107 of the pivot guide 96 is about dimension X of the entrance portion 90, allowing the pivot guide 96 to enter into the recess 88. As the door 14 is swung open, the protrusion 108 sweeps about the wider body portion 92 (shown in FIG. 13) as illustrated by arrow 101, locking the door 14 around the pivot guide 96.

Figure 19:
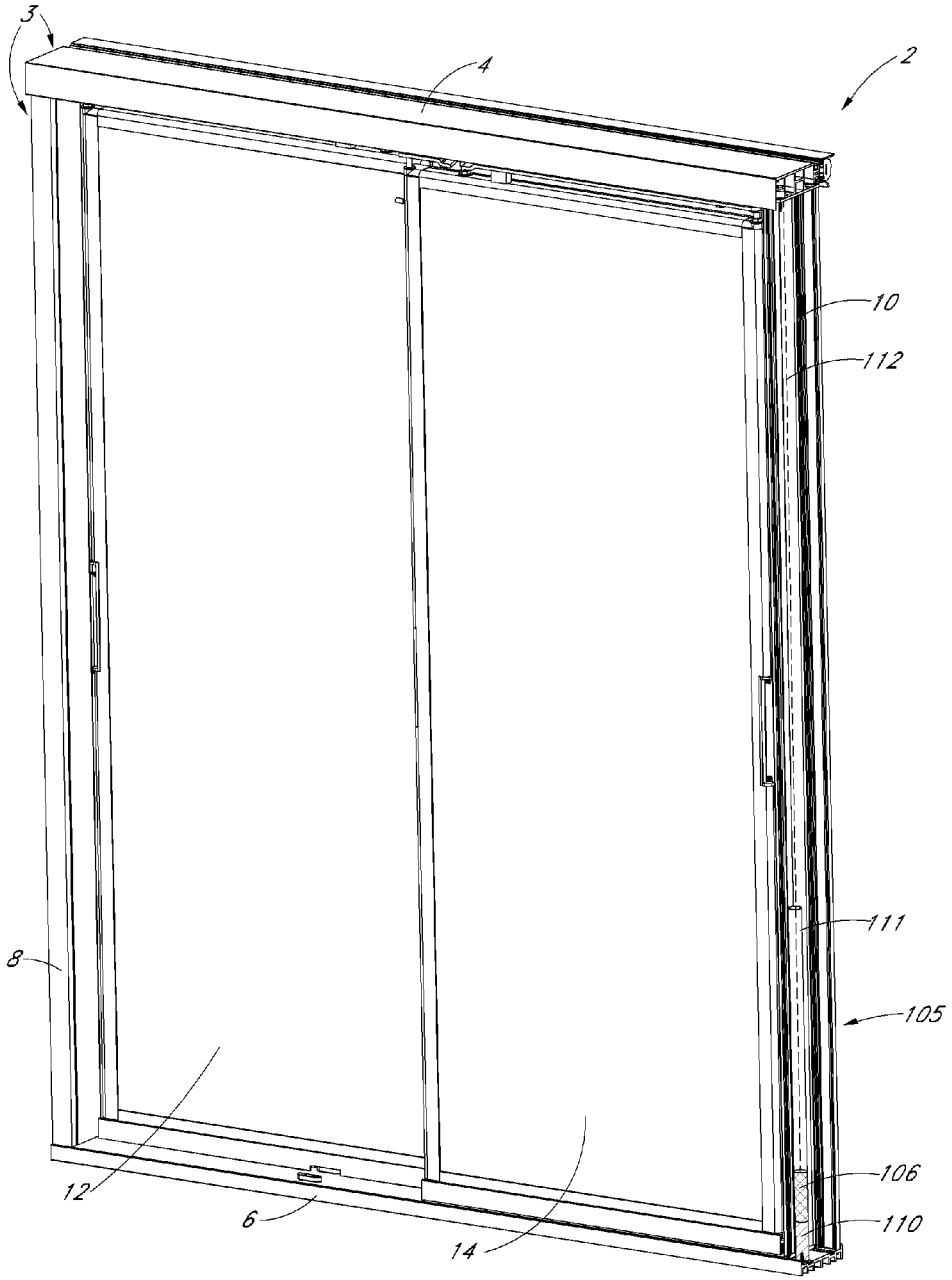
FIG. 19 shows a perspective view of an embodiment of a doorframe 3 with a counterweight assembly.
Figure 20:
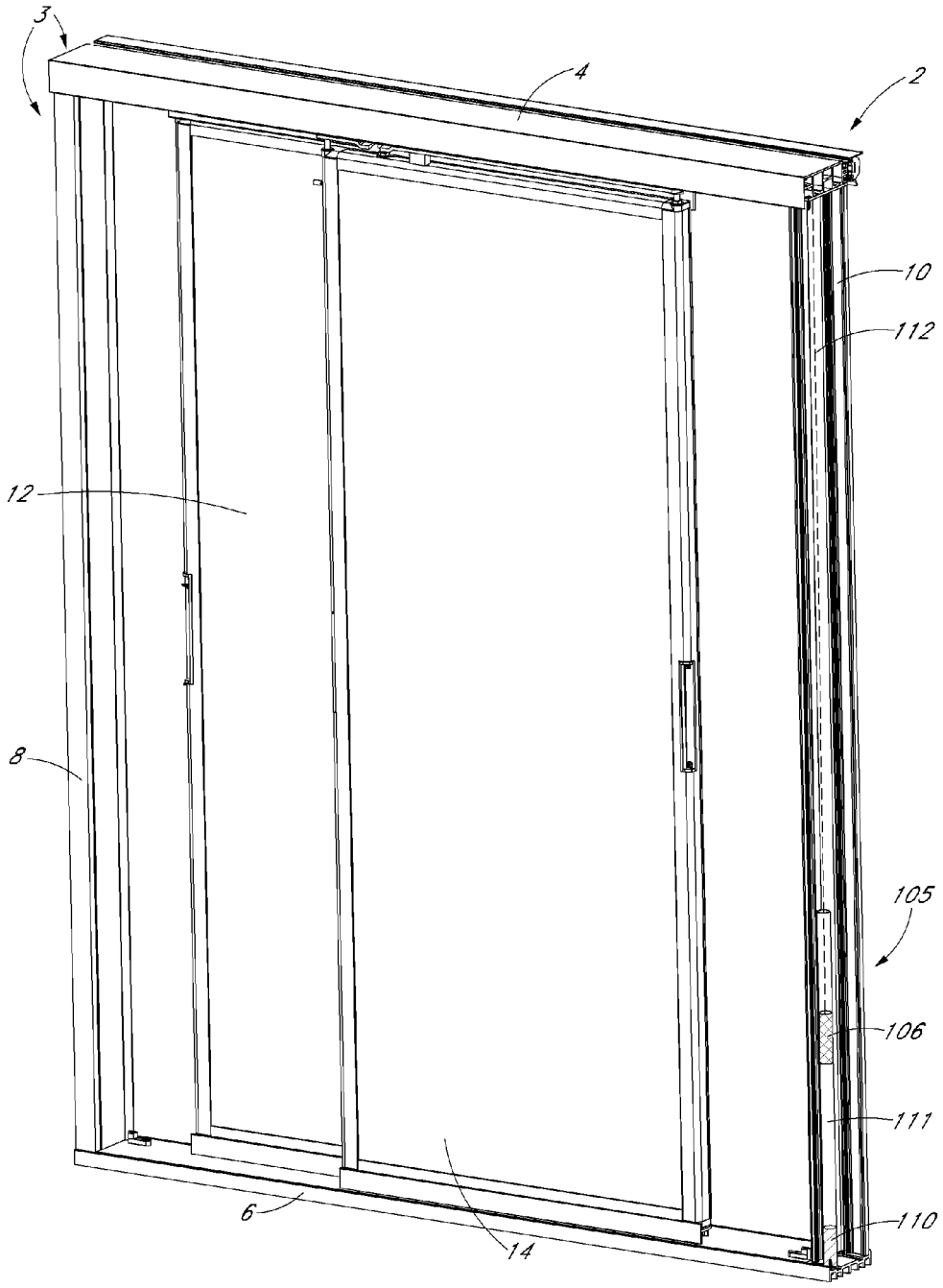
FIG. 20 shows a perspective view of an embodiment as the door is slid with counterweight assembly along the doorframe.

FIG. 19 shows a perspective view of an embodiment of a doorframe 3 with a counterweight assembly 105. The counterweight assembly 105 can have a counterweight 106 positioned in a cylinder 111. The counterweight 106 can be attached to the carrier 55 with a wire or other linear material 112 (e.g., via a pulley in the top frame 4 of the doorframe 3). In some embodiments, the attachment of the counterweight 106 to the carrier 55 can be with a rope, belt, chain, and/or the like. The counterweight 106 biases the door 14 toward the second side frame 10. FIG. 20 shows a perspective view of an embodiment as the door 14 is slid along the doorframe 3. The counterweight assembly 105 can have a bleed valve 110 positioned near the bottom frame 6 within the cylinder 111. When the door 14 is slid open, the carrier 35 pulls on the wire 112. As the wire 112 is pulled up, the counterweight 106 moves up in the cylinder 111, creating an air gap between the counterweight 106 and the bleed valve 110. When the slid open door 14 is released, the counterweight 106 pulls on the carrier 35, sliding the door 14 back, and pushes against the air gap in the cylinder 111, forcing air to escape through the bleed valve 110. In some embodiments, the bleed valve 110 can be adjusted to regulate the rate of air that escapes from the bleed valve 110, which can regulate the velocity of descent of the counterweight, which can in turn regulate the velocity with which the door 14 is brought back toward the second side frame 10. In some embodiments, the bleed valve 110 has a turn-dial mechanism that allows a user to regulate the rate of air bleeding. Though the counterweight assembly 105 is described above in connection with the door 14, one of skill in the art will recognize that a second counterweight assembly can be disposed in the first side frame 8 of the doorframe 3 and attached to the door 12 in the same manner.

The above embodiments, mechanisms, methods, and discussion at relating just to the second door 14 are for illustrations purposes only. The same embodiments, mechanism, methods, and discussion can be applied to the first door 12. In some embodiments, the second door 14 will be swung open first before the first door 12 can be swung open as described herein.

The foregoing detailed description has set forth various embodiments of the systems and/or methods via the use of figures and/or examples. Insofar as such figures and/or examples contain one or more functions and/or operations, it will be understood by those within the art that each function and/or operation within figures or examples can be implemented individually and/or collectively. The herein described subject matter sometimes illustrates different components contained within, or connected with, different other components. It is to be understood that such depicted architectures are merely examples and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the following disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" or "one of the A, B, or C," etc. is used, in general such a construction is intended in the sense one having skill in the art would understand the convention (e.g., "a system having at least one of A, B, and C (or one of the A, B, or C)" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A door system comprising:

a doorframe having a top frame, a bottom frame, a first side frame extending between the top frame and the bottom frame, and a second side frame extending between the top frame and the bottom frame, and the bottom frame including one or more sliding guides and one or more pivot guides;

a first door of one or more doors movably coupleable to the doorframe, each of the one or more doors having an upper end, a lower end, a first side extending between the upper end and the lower end, and a second side extending between the upper end and the lower end, the lower end of the first door comprising a u-channel configured to slidably receive the one or more sliding guides therethrough as the first door is slid from side to side relative to the doorframe, the u-channel having one or more cutouts on side surfaces thereof sized to allow the one or more sliding guides to pass through the one or more cutouts when the first door is pivotably moved relative to the doorframe;

a carrier assembly coupled to each of the one or more doors and having a first end and a second end, the carrier assembly interposed between the upper end of the first door and the top frame of the doorframe, the carrier assembly configured to movably couple the first door to the doorframe, the second end of the carrier assembly coupled to the upper end of the first door proximate the second side of the first door so as to provide a pivot point that at least partially defines a pivot axis of the first door, the first end of the carrier assembly configured to releasably couple to the upper end of the first door via a guide point assembly proximate the first side of the first door so as to releasably lock the first door in an orientation along a sliding plane defined by the doorframe;

wherein the carrier assembly is configured to move between the first side frame and the second side frame, the first door being configured to slide between the first side frame and the second side frame along with the carrier assembly such that the u-channel slides along the one or more sliding guides of the bottom frame; and wherein, when the second side of the first door and the second end of the carrier assembly substantially abut the second side frame, the one or more sliding guides of the bottom frame are generally aligned with the one or more cutouts of the u-channel, and one of the one or more pivot guides of the bottom frame at least partially engages a recess of the u-channel, thereby allowing the first door to pivot out from the doorframe about the pivot axis, the first door configured to separate from the carrier assembly at the guide point assembly.

2. The door system of claim 1, wherein the guide point assembly connecting the first door and the carrier assembly comprises a locking latch configured to inhibit the first door from pivoting out from the doorframe when the second end of the carrier assembly does not substantially abut the second side frame.

3. The door system of claim 1, wherein the guide point assembly connecting the first door and the carrier assembly comprises a ramp member formed in the carrier assembly and a bushing connected to the first door, the bushing configured to slide onto the ramp member to provide support for the first door against the carrier assembly when the first door is moved from a pivoting position outward from the doorframe to a sliding position co-planar with the sliding plane defined by the doorframe.

4. The door system of claim 1, wherein the first door comprises a spring-loaded locking pin assembly configured to releasably engage an opening in the carrier assembly to inhibit the first door from pivoting out from the doorframe, the locking pin being selectively actuatable to unlock the first door from the carrier assembly so as to pivot the first door outward from the doorframe.

5. The door system of claim 1, wherein the first door comprises a handle frame positioned on the second side of the first door, the handle frame configured to be substantially flush with the second side of the first door, thereby allowing the first door to pivot outward relative to the doorframe when the second side of the first door is adjacent to the doorframe.

6. The door system of claim 1, wherein the one or more pivot guides of the bottom frame each comprise a sliding guide portion and a protrusion portion, the sliding guide portion configured to allow the u-channel to slide from side to side relative to the doorframe, and the protrusion configured to engage the recess of the u-channel.

7. The door system of claim 1, wherein the carrier assembly comprises a locking lever assembly configured to inhibit the carrier assembly from sliding along the top frame when the first door is pivoting out from the doorframe.

8. The door system of claim 1, wherein the carrier assembly comprises a roller assembly configured to roll within a track channel of the top frame of the doorframe between the first side frame and the second side frame, and wherein the roller assembly comprises one or more roller wheels having ridges and the track channel comprises a c-channel, the c-channel configured to engage the ridges of the one or more roller wheels, the ridges configured to maintain the position of the one or more roller wheels within the c-channel.

9. The door system of claim 1, further comprising a counterweight assembly connected to the carrier assembly, the counterweight configured to bias the carrier assembly and the first door to substantially abut the second side frame such that the first door is biased in a closed sliding position.

10. A door comprising:

a door movably coupleable to a doorframe, the door having an upper end, a lower end, a first side extending between the upper end and the lower end, and a second side extending between the upper end and the lower end, the lower end of the door comprising a u-channel configured to slidably receive one or more sliding guides connected to the doorframe therethrough as the door is slid from side to side relative to the doorframe, the u-channel having one or more cutouts on side surfaces thereof sized to allow the one or more sliding guides to pass therethrough when the door is pivotably moved relative to the doorframe;

a carrier assembly having a first end and a second end, the carrier assembly configured to movably couple the upper end of the door to the doorframe, the carrier assembly releasably coupleable to the upper end of the door at a guide point assembly near the first side of the door, and the carrier assembly additionally coupled to the upper end of the door at a pivot point near the second side of the door;

wherein, when the second side of the door abuts a side of the doorframe, the one or more sliding guides connected to the doorframe are generally aligned with the one or more cutouts of the u-channel and one of the one or more pivot guides of the doorframe at least partially engages a recess of the u-channel such that the door can pivot out from the doorframe about a pivot axis defined by the pivot point and the pivot guide, the door configured to separate from the carrier assembly at the guide point assembly.

11. The door of claim 10, wherein the carrier assembly is coupled to a roller assembly, the roller assembly configured to roll within a track channel of the doorframe to allow the carrier assembly to slide from side to side relative to the doorframe, thereby moving the door from side to side relative to the doorframe such that the u-channel slides along the one or more sliding guides of the bottom frame.

12. The door of claim 11, wherein the roller assembly comprises one or more roller wheels having ridges configured to engage a c-channel of the track channel such that roller assembly maintains substantially a same level position relative to the track channel.

13. The door of claim 10, wherein the carrier assembly comprises a locking lever assembly configured to engage the doorframe to inhibit the carrier assembly from sliding along the doorframe when the door is pivoting out from the doorframe.

14. The door of claim 13, wherein the door is configured to release a spring-loaded locking lever of the locking lever assembly from the doorframe when the door is co-planar with a sliding plane defined by the doorframe, thereby allowing the carrier assembly to slide along the doorframe when the door is oriented along the sliding plane.

* * * * *